United States Patent [19]

Izraeli

[11] 4,144,737

[45] Mar. 20, 1979

[54] ADJUSTING MECHANISM FOR A TOOL

[75] Inventor: Hyman Izraeli, West Caldwell, N.J.

[73] Assignee: Thomas & Betts Corporation, Raritan, N.J.

[21] Appl. No.: 847,545

[22] Filed: Nov. 1, 1977

[51] Int. Cl.[2] ..... B21D 9/08

[52] U.S. Cl. ..... 72/409; 81/393

[58] Field of Search ..... 72/409, 410; 81/385, 81/393

[56] References Cited

U.S. PATENT DOCUMENTS

| | | | |
|---|---|---|---|
| 2,086,400 | 7/1937 | Brenizer | 81/393 |
| 2,685,130 | 8/1954 | Tibbetts | 81/393 |
| 2,746,327 | 5/1956 | Runde | 72/409 |
| 3,330,148 | 7/1967 | Hornung | 72/410 |
| 3,958,442 | 5/1976 | Walia | 72/410 |

FOREIGN PATENT DOCUMENTS

| | | | |
|---|---|---|---|
| 999596 | 7/1965 | United Kingdom | 72/410 |

*Primary Examiner*—C.W. Lanham
*Assistant Examiner*—Gene P. Crosby
*Attorney, Agent, or Firm*—David Teschner; Jesse Woldman

[57] ABSTRACT

A mechanism for use in crimping and cutting tools and the like includes a resettable drive system which permits the user to selectively increase or decrease the angular opening between the tool handles at any fixed point in the operative stroke of the tool. The handles of the tool may thus be disposed at any desired angular relationship with respect to one another for operation either in close quarters or for more comfortable operation without sacrificing the lever advantage originally designed into the tool.

16 Claims, 14 Drawing Figures

ADJUSTING MECHANISM FOR A TOOL

BACKGROUND OF THE INVENTION

1. Field of the Invention

The invention is directed to the field of drive mechanisms for hand operated tools and the like.

2. Description of the Prior Art

Various prior art tools for use, for example, in the electrical industry are well known in the art and include crimpers, cable cutters, or other similar devices which are provided with relatively long handles to permit the user to obtain the necessary leverage for accomplishing a particular operation. In many cases the user is required to operate the tool in restricted or cramped quarters where the limited space prevents the user from fully spreading the handles of the tool, thereby restricting the available jaw opening. It has also been found that a user may experience great difficulty in attempting to apply the necessary force to the handles of the tool at the initiation of the operative stroke when the handles are angularly disposed at an included angle virtually approaching 180 degrees. A prior art device for at least partially alleviating the above problems is disclosed in U.S. Pat. No. 3,958,442 issued to Walia et al. on May 25, 1976. Although this device is designed to provide an adjustable handle for reducing the angular position of the handles at any given point in the operative stroke, the structure by which this is accomplished requires a two part handle member which, upon resetting of such handle, significantly reduces the leverage available from the handle when the resetting mechanism is employed to accomplish its stated purpose. Furthermore, the device requires a rather complex manipulation of a movable sleeve on the breakaway handle to reset the handle.

SUMMARY OF THE INVENTION

The invention overcomes the limitations and difficulties noted above with respect to prior art devices by providing a mechanism for use in either single or multiple stroke crimping or cutting tools and the like which permits the selective resetting of the angular position of the handles or arms of a manually operated tool during the operative stroke of the tool without varying the position of the tool jaws in a simpler, more convenient, and more versatile manner than in such prior art devices. The resetting mechanism includes, in a preferred embodiment, a pawl and ratchet arrangement whereby the ratchet portion comprises an arcuate segment coupled to one of the jaws of the tool at its juncture with a corresponding handle member, and a pawl member coupled to such corresponding handle member and which is releasably biased into operative engagement with the arcuate segment at any preselected point along the toothed outer surface of the arcuate segment. Thus, the full length of the handle member is employed to apply leverage to the jaw members regardless of where the corresponding handle member has been reset in the operative stroke. Such resetting is accomplished without any variation of the relative position of the jaw members so that any previously applied compressive force between the jaw members is maintained during the resetting operation. Several embodiments for accomplishing the release or disengagement of the pawl member from the arcuate segment are shown and include a selectively rotatable handle member having means thereon for deflecting the pawl member, and modifications of a portion of the pawl member to permit its direct manipulation by the user. The resetting mechanism is shown as applicable to various types of tools which include those employing a four bar linkage system and others employing simply a pair of pivotable jaw members directly fastened to their associated handle members. In each case the pawl member is provided with suitable biasing means for urging the pawl member into engagement with the arcuate segment. The relative locations of the pivot upon which the pawl is mounted and the pivot upon which the arcuate segment is mounted are so designed as to insure maximum engagement between these two parts during the operative stroke. It is therefore an object of this invention to provide an improved handle resetting mechanism for hand tools and the like.

It is another object of this invention to permit the use of relatively long handled cutter and crimping tools in confined spaces.

It is a further object of this invention to permit the user of a relatively long handled tool to vary or reset the angular position between the handles of the tool at will without disturbing the relative position of the jaw members at any fixed point in the operative stroke of the tool.

It is still another object of this invention to permit the user of a relatively long handled tool to reset such handles to any comfortable or convenient angular position at any fixed point in the operative stroke of such tool.

It is yet a further object of this invention to increase the versatility of a four bar linkage mechanism in a hand operated tool or the like.

It is still a further object of this invention to provide a resettable handle mechanism in a hand operated tool without affecting the maximum leverage available from such tool.

It is yet another object of this invention to provide a handle adjusting mechanism for a hand operated tool which permits the user to maximize the moment of force applied to the handles at any given point in the operative stroke.

Other objects and features of the invention will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings

Similar elements are given similar reference characters in each of the respective drawings.

DESCRIPTION OF THE PREFERRED EMBODIMENTS

Figure 1:
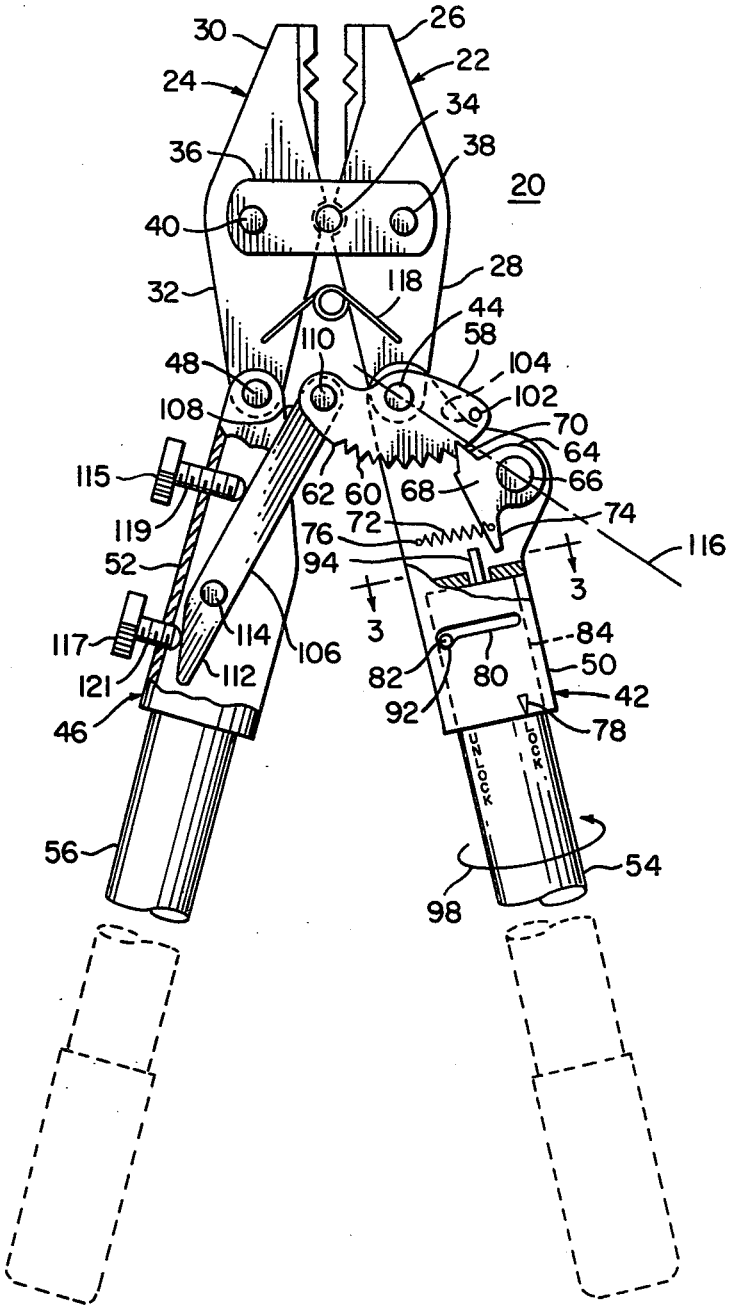
FIG. 1 is a front elevational view, partly cut away and partly in section, of a tool including a handle resetting mechanism constructed in accordance with the concepts of the invention.
Figure 2:
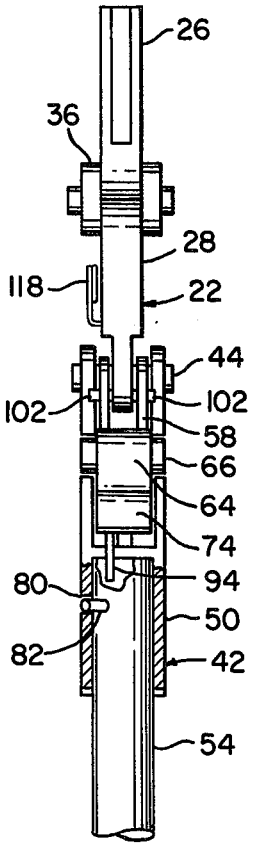
FIG. 2 is a fragmentary side elevational view, partly cut away and partly in section, of the device of FIG. 1.
Figure 3:
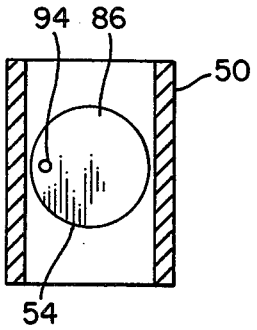
FIG. 3 is a top plan view, partly in section, taken along the line 3—3 of FIG. 1.
Figure 4:
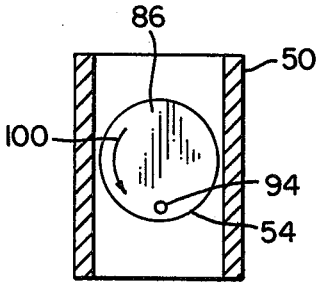
FIG. 4 is a top plan view similar to FIG. 3 showing a pawl release mechanism in its release position.
Figure 5:
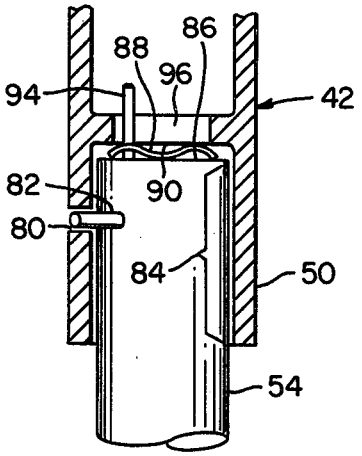
FIG. 5 is a fragmentary front elevational view, partly in section, showing details of the release mechanism of the device of FIG. 1.
Figure 6:
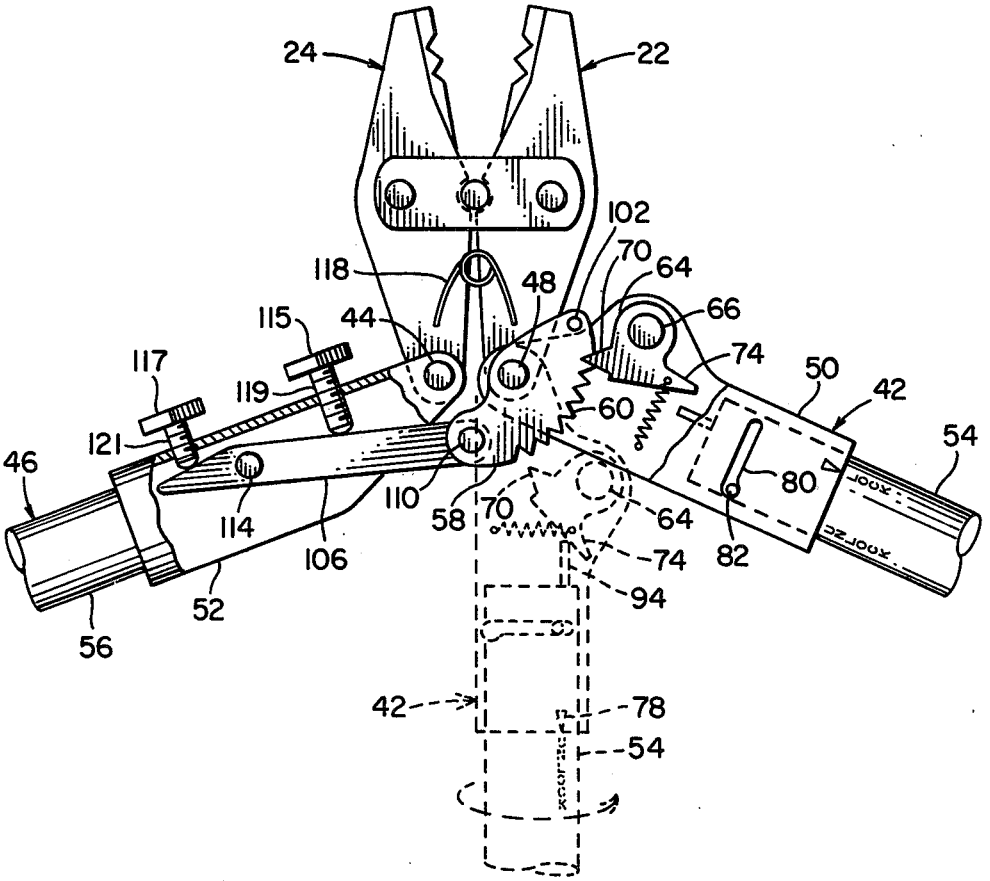
FIG. 6 is a fragmentary front elevational view, partly cut away and partly in section, of the device of FIG. 1 showing the various positions to which one handle member of the device may be reset.
Figure 13:
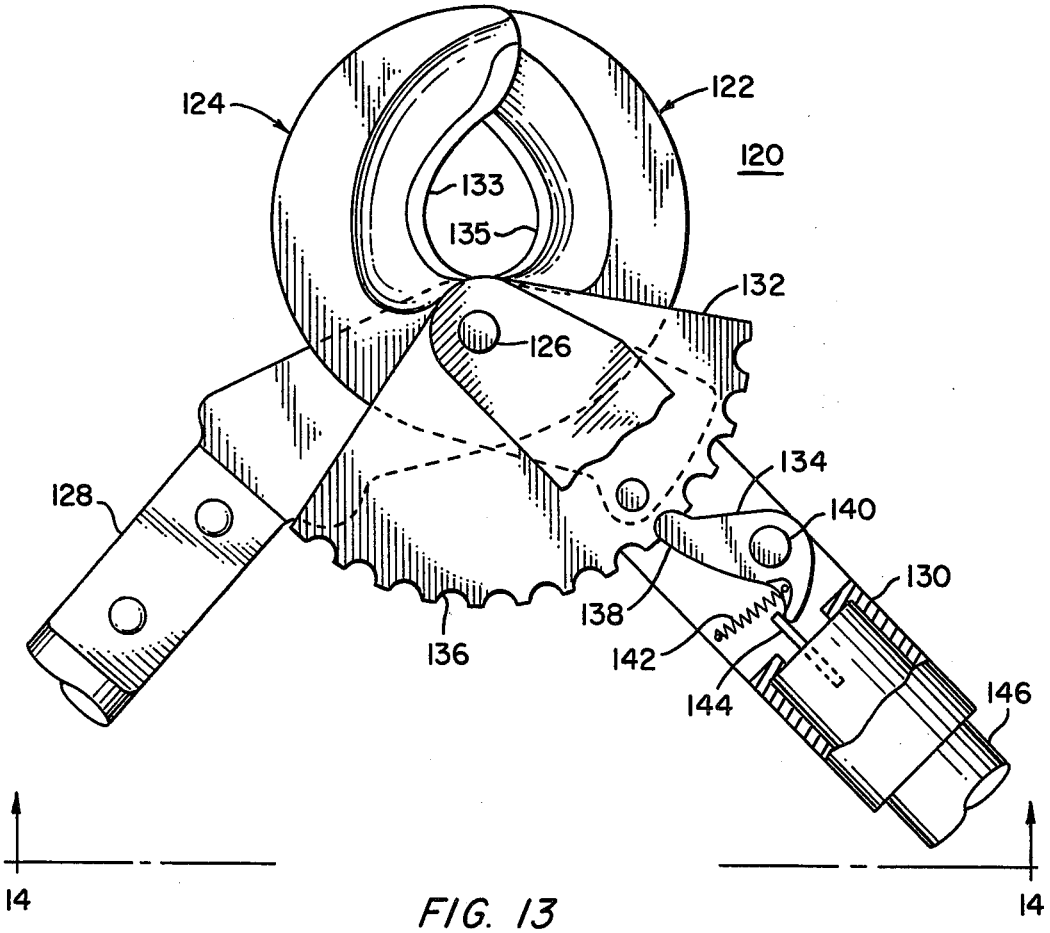
FIG. 13 is a fragmentary front elevational view, partly cut away and partly in section, of a further embodiment of a handle resetting mechanism for a cutting tool constructed in accordance with the concepts of the invention.
Figure 14:
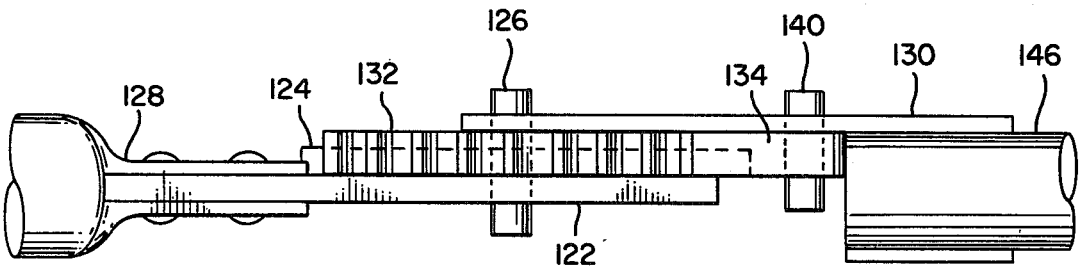
FIG. 14 is a bottom plan view taken along the line 14—14 of FIG. 13.

Turning now to FIGS. 1 through 6 there is shown a tool 20 constructed in accordance with the concepts of the invention, including first and second jaw members 22 and 24 having respective first and second end portions 26 and 28, and 30 and 32, and pivotable about a common point shown as a pivot pin 34. A transverse link member 36 is coupled to the jaw members 22 and 24 by pins 38 and 40 to keep the jaw members 22 and 24 in position against the pin 34. The second end portion 28 of the first jaw member 22 is pivotally coupled to a first handle member 42 by means of a pin 44, while the second end portion 32 of the second jaw member 24 is similarly coupled to a second handle member 46 by means of a pin 48. The handle members 42 and 46 each comprise respective first portions 50 and 52 adjacent the respective jaw members 22 and 24, and respective second portions 54 and 56 extending from the respective first portions 50 and 52. The second portion 56 of handle member 46 is preferably rigidly attached to the first portion 52 while, in the embodiment shown in FIG. 1, the second portion 54 of handle member 42 is rotatable within the first portion 50 through a predetermined arc about its longitudinal axis for purposes which will be described in greater detail hereafter. Coupled to the second end 28 of the first jaw member 22 by means of pin 44 is a first element shown preferably as an arcuate segment 58 having a series of teeth 60 selectively located along its convexedly curved exterior edge 64 for engagement with a second element shown as a pawl means 64 which is movably coupled by means of pin 66 to the first portion 50 of handle member 42. The pawl means 64 includes a body portion 68 from which extends a tooth 70 arranged to mate and engage with the teeth 60 of segment 58 and is biased into an engaging position by means of a spring 72 which is attached at one end to an extension 74 on the pawl means 64 and at its other end to the first portion 50 of the handle member 42 by means of a pin 76. In the embodiment illustrated in FIG. 1, the tooth 70 of pawl means 64 may be released from engagement with the teeth 60 of the segment 58 by rotating the second portion 54 of the handle member 42 from a first or lock position to a second or unlock position. These two positions are identified by suitable indicia indicated by similar words on the second portion 54 of the first handle member 42, as shown in FIG. 1, which are arranged to be aligned with a reference indicator 78 located on the first portion 50 of the first handle member 42. The first portion 50 of the handle member 42 is provided with a slotted opening 80 which serves as a guide for pin 82 which extends outwardly from the surface of the part 84 of the second portion 54 of the handle member 42 located within the first portion 50. As shown in the sectional view of FIG. 5, the part 84 of the second portion 54 of the handle member 42 comprises a relatively flat end surface 86 on which is located a resilient washer 88 which bears against the adjacent undersurface 90 of the first portion 50, thus biasing the second portion 54 downwardly, as viewed in FIG. 5, away from the first portion 50 to permit the pin 82 to be forcibly seated within an enlarged recess 92 (FIG. 1) located at one end of the slotted opening 80 when the second handle portion 54 is oriented to the "lock" position as shown in FIG. 1. In this position, a release pin 94 extending longitudinally outwardly from the end surface 86 of the second handle portion 54 and located to one side of the central axis thereof (See FIGS. 3 and 4) is spaced away from and out of contact with the extending portion 74 of the pawl means 64. To accommodate the movement of the pin 94, the first portion 50 of the first handle portion 42 is provided with a central opening 96 (FIG. 5) through which the pin 94 protrudes. To rotate the second handle portion 54 to the "unlock" position, a slight pressure is applied to the second handle portion 54 in an upward direction, as viewed in FIG. 1, to compress the resilient washer 88 and release the pin 82 from the recess 92. The handle portion 54 is then rotated in a clockwise direction, as indicated by the arrow 98 in FIG. 1, to cause the pin 82 to traverse the slotted opening 80 and come to rest at the right end of the slotted opening 80, as viewed in FIG. 1, at which position the word "unlock" is aligned with the indicator 78. The movement of the release pin 94 from the "lock" to the "unlock" position is shown respectively in FIGS. 3 and 4, the direction of movement being shown by the arrow 100 in FIG. 4, which corresponds to the movement of the handle portion 54 shown by the arrow 98 in FIG. 1. In the "unlock" position, the release pin 94 is caused to contact the extending portion 74 of the pawl means 64, as shown in the dotted outline in FIG. 6, thereby rotating the pawl means 64 in a counterclockwise direction, as viewed in FIG. 6, and causing the pawl means tooth 70 to be moved out of engagement with the teeth 60 on the arcuate segment 58. Th handle member 42 is accordingly unlocked from its previous position and may be reset or reoriented to a new angular position with respect to the other handle member 46, as shown by the dotted handle member outline in FIG. 6. It should be understood that the included angle between the handle member 42 and the other handle member 46 may be increased without moving the second handle portion 54 to the "unlock" position, but rather by employing the normal ratcheting action of the pawl means 64 on the reverse stroke whereby the pawl means tooth 70 is caused to "ride" along the teeth 60 on the arcuate segment 58. When the desired new angular position of handle member 42 is reached, the second handle portion 54 of the first handle member 42 is rotated back to its "lock" position, as previously described, thus causing the release pin 94 to return to the position shown in FIG. 1 whereby the tooth 70 of the pawl means 64, under the influence of the biasing spring 72, is urged back into engagement with the teeth 60 on the arcuate segment 58, permitting the user to once again move the jaw members 22 and 24 in correspondence with the reset handle positions. This procedure may be repeated as often as necessary or desirable to provide the most comfortable or convenient disposition of the handle members 42 and 46 before, during, and after the operative cycle. To insure that the jaw members 22 and 24 are returned to an open position when the pawl means 64 is in the released position out of contact with the segment 58 and the handle member 42 is moved away from the handle member 46, the segment 58 may be provided with a protrusion 102 which is arranged for contact with a portion 104 of the peripheral surface of the segment 58. Thus, as the handle member 42 is moved in a counterclockwise position about the pin 44, as viewed in FIG. 1, the segment 58 is caused to follow the handle member 42, thereby forcing the pins 44 and 48 towards one another through a coupling comprising a link 106 which is pivotally coupled at one end 108 to one end of the segment 58 by a pin 110, and at its other end 112 to the first portion 52 of the second handle member 46 by a pin 114, and through the first portion 52 of the second handle member 46 to the pin 48 connecting the second handle member 46 to the second jaw member 24. First and second adjusting means shown respectively as threaded screw members 115 and 117 include respective shank portions 119 and 121 which extend transversely through suitable threaded openings in the first portion 52 of the second handle member 46 and abut the link 106 on either side of the link pin 114 to regulate the closure of the jaw members 22 and 24 by fixing the position of the coupling pin 110 relative to the jaw member pins 44 and 48 throughout the operative stroke. It should be noted that, in the particular embodiment illustrated in FIG. 1, the axis of the tooth 70 of the pawl means 64 is offset to the left of an axis 116 bisecting the pivot pins 44 and 66. Thus, as the handle member 42 is rotated about the pin 44 in a driving or clockwise stroke, as viewed in FIG. 1, the tooth 70 is driven into locking relationship with a respective one of the teeth 60 so that a compressive force is exerted on the pawl means 64 which is counteracted by the pin 66 which is thus caused to bear a major portion of the driving force. This arrangement significantly minimizes any shear force which may be exerted against the tooth 70, thereby providing for a more efficient and reliable drive system. However, as a result of such relationship, the pawl means 64 is caused to "ride" along the teeth 60 of the segment 58 in the backward or release stroke, thereby necessitating the employment of means such as the protrusion 102 for engagement with the handle member 42 to reposition the jaw members 22 and 24 into an open state after completion of the compressive stroke. A means such as spring member 118 is coupled between the respective second ends 28 and 32 of jaw members 22 and 24 to apply a separating force to the second ends 28 and 32 and, consequently, an equivalent closure force to the respective first ends 26 and 30 of the jaw members 22 and 24 to assist in holding a workpiece such as a terminal, or the like (not shown), between the jaw members 22 and 24 while the first handle member 42 is operatively disengaged from its respective jaw member 22, that is, when the pawl means 64 is in the "unlock" position. It should be noted that the operating mechanism employed in the tool 20 comprises generally a modified form of a conventional four-bar linkage in which jaw members 22 and 24 define two of the linkages, link member 106 defines the third linkage, and segment 58 together with pawl means 64 defining the modified fourth linkage. The invention may, however, be incorporated in other tool arrangements such as shown, for example, in FIGS. 13 and 14. A scissor-like tool 120, shown in fragmentary view in FIG. 13, comprises a pair of arcuate jaw members 122 and 124 movable in a common plane towards and away from one another and coupled together at a common pivot by means of a pin 126. Each jaw member 122 and 124 is provided with a respective extending handle portion 128 and 130 for moving the jaw members 122 and 124. The jaw members 122 and 124 are each provided with a respective tapered arcuate inner cutting edge 135 and 133 for severing elongate objects such as copper, aluminum, or steel cables or the like which, in many cases, require relatively large cutting forces. In most manually operated tools this is accomplished by providing large lever advantages to suitably multiply the available manual force. Accordingly, as in the tool 20 described above, the handle portions 128 and 130 of tool 120 may often assume a length of one meter or more which may prevent the use of the tool in confined spaces while additionally presenting a highly inconvenient handle disposition at the initiation of the operative stroke. Thus, an arrangement similar to that provided in tool 20 may be employed in the tool 120 to reset or adjust the relative angular disposition of the handle portions 128 and 130 at any fixed point in the operative stroke. To accomplish this function, the handle portion 130 is coupled to its respective jaw member 124 through elements 132 and 134 which are essentially duplicative of elements 58 and 64 of tool 20 and operate in a similar manner. Element 132 comprises an arcuate segment having a series of teeth 136 which are selectively engageable with a tooth 138 located on the element 134 which defines a pawl means pivotable about a pin 140 and biased into engagement with the element 132 by means of a spring 142. The release mechanism comprising part 144 associated with a rotatable handle portion 146 is essentially similar to corresponding parts 94 and 54 of tool 20 and operate in a similar manner. Thus, by releasing the element 134 from engagement with the tooth element 132, the handle portion 130 is free to rotate about the pivot pin 126 without disturbing or changing the relative disposition of the jaw members 122 and 124. Accordingly, the user may unlock the mechanism comprising parts 132 and 134, reset the handle portion 130 at any desired angular disposition with respect to the other handle portion 128, and then relock the mechanism to initiate or continue the operative stroke at the new handle position.

Figure 7:
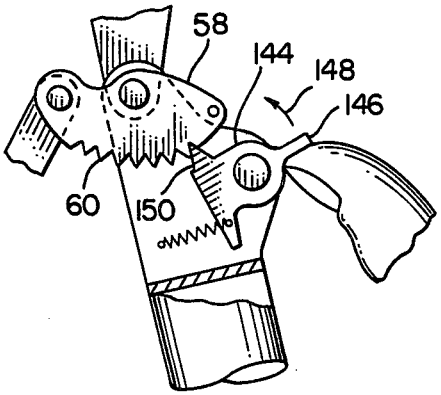
FIG. 7 is a fragmentary view, partly cut away and partly in section, showing a further embodiment of a pawl release means for a resetting mechanism constructed in accordance with the concepts of the invention.

FIGS. 7 through 12 illustrate further embodiments of a pawl release mechanism for an adjustable tool handle constructed in accordance with the concepts of the invention. In FIG. 7 a pawl means 144 similar to element 64 of tool 20 includes an exposed lever portion 146 which may be manually contacted by the user for rotating the pawl means in the direction indicated by the arrow 148 to move the pawl means tooth 150 out of engagement with the teeth 60 of the arcuate segment 58.

Figure 10:
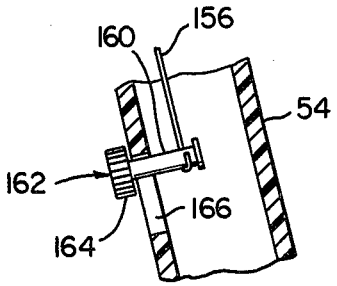
FIG. 10 is a fragmentary view, partly cut away and partly in section, showing a further detail of the device of FIG. 9.
Figure 8:
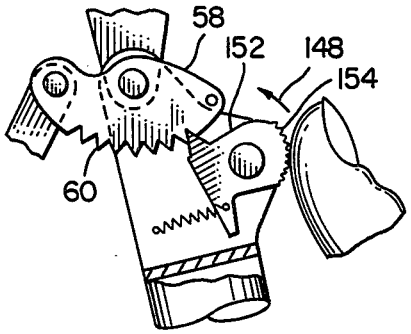
FIG. 8 is a fragmentary view, partly cut away and partly in section, of yet another embodiment of a pawl release means for a resetting mechanism constructed in accordance with the concepts of the invention.
Figure 11:
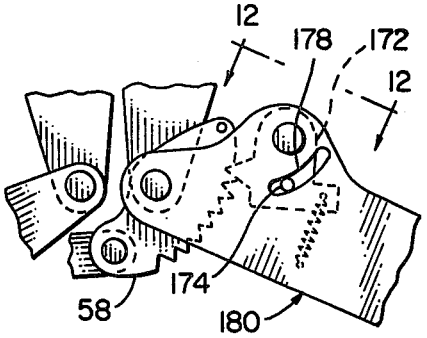
FIG. 11 is a fragmentary view of yet another embodiment of a pawl release means for a resetting mechanism constructed in accordance with the concepts of the invention.
Figure 9:
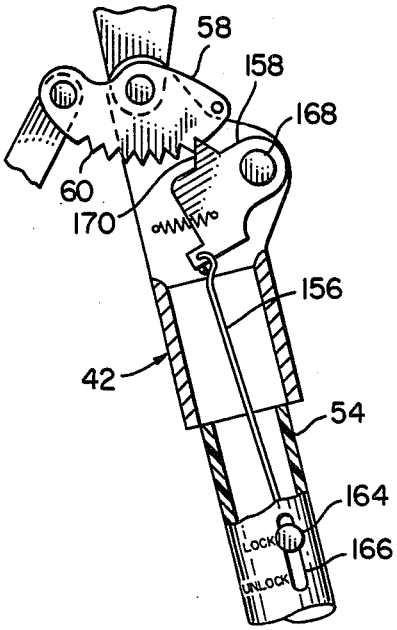
FIG. 9 is a fragmentary view, partly cut away and partly in section, of still a further embodiment of a pawl release means for a resetting mechanism constructed in accordance with the concepts of the invention.
Figure 12:
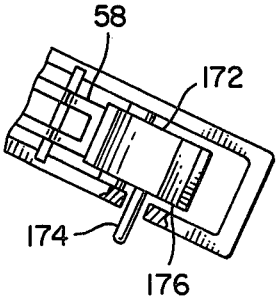
FIG. 12 is a fragmentary view, partly cut away and partly in section, taken along the line 12—12 of FIG. 11.

In FIG. 8 a similar release is accomplished by providing a pawl means 152 with an exposed knurled portion 154 for engagement by the user. A further alternative embodiment of a release means constructed in accordance with the concepts of the invention is shown in FIGS. 9 and 10 and includes a strut member 156 connected between a pawl means 158 and a shank portion 160 of a release activator 162 having a manually operable head portion 164 connected to the shank portion 160 and extending through a slot 166 in the second portion 54 of the first handle member 42. To release the pawl means 158 from engagement with the arcuate segment 58, the head portion 164 of the activator 162 is manually moved from the LOCK position to the UNLOCK position causing the pawl means 158 to rotate in a counterclockwise direction, as viewed in FIG. 9, about its pivot pin 168, thereby releasing the pawl means tooth 170 from engagement with the segment teeth 60. In FIGS. 11 and 12, the release operation is accomplished by providing a pawl means 172 with a manually operable lever member 174 extending outwardly from a side surface 176 thereof and through an arcuate slot 178 in a first handle member a portion of which is indicated by the numeral 180. Movement of the lever member 174 from the lower left position shown in FIG. 11 to the upper right end of the slot 178 will cause a corresponding rotational movement of the pawl means 172 to disengage it from the segment 58.

It will, of course, be readily appreciated that the resetting mechanism comprising the elements 58 and 64, although shown as provided for resetting or adjusting only one of the two handle members of tools such as 20 and 120, may be provided for resetting or adjusting both of the handle members (not shown) where necessary or desirable. Furthermore, although the interengagement between the segment 58 and the pawl means 64 is shown as comprising a mating tooth arrangement, such interengagement may be accomplished by alternative means such as pin and groove arrangements (not shown) in which the tooth 70 of pawl means 64 is replaced by a pin means which is selectively received within suitably dimensioned recesses or transverse holes provided at selected locations in the segment 58.

The embodiments of the invention in which an exclusive property or privilege is claimed are defined as follows:

1. In a tool of the type having a pair of jaw members individually coupled to corresponding handle members and movable about a common pivot, the improvement comprising: means for selectively resetting the angular position of a first of said handle members with respect to a second of said handle members at any fixed point in the operative stroke of said tool without varying the position of said jaw members, said means including a first element located at the juncture between said first handle member and its associated jaw member and operatively coupled to said associated jaw member, and a second element coupled to said first handle member and releasably engageable with said first element at selective locations thereon.

2. The improvement as defined in claim 1 further including biasing means cooperative with said second element for urging said second element into releasable engagement with said first element.

3. The improvement as defined in claim 1 further including means for releasing the engagement between said first element and said second element.

4. The improvement as defined in claim 1 wherein said second element comprises a pawl member and said first element comprises an arcuate segment having a series of recessed portions for engaging said pawl member.

5. The improvement as defined in claim 4 wherein said pawl member is pivotally coupled to said first handle member for rotation into and out of engagement with said arcuate segment.

6. The improvement as defined in claim 1 wherein said first element is operatively coupled to both said first handle member and said second handle member.

7. The improvement as defined in claim 1 wherein said first element is operatively coupled to both of said jaw members.

8. The improvement as defined in claim 1 wherein said first element comprises an arcuate segment operatively coupled to both said first handle member and said second handle member.

9. The improvement as defined in claim 1 wherein said first element comprises an arcuate segment operatively coupled to both of said jaw members.

10. The improvement as defined in claim 1 further comprising stop means on said second handle member cooperative with said first element to limit the extent of arcuate travel of said first handle member with respect to said first element.

11. The improvement as defined in claim 3 wherein said means for releasing comprises a protruding member on said first handle member which is movable from a first position out of engagement with said second element, to a second position whereby said protruding member contacts said second element and moves said second element in a direction arranged to cause said second element to be disengaged from said first element.

12. The improvement as defined in claim 3 whereby said means for releasing comprises a portion on said second element which is exposed for manual manipulation of said second element by a user.

13. The improvement as defined in claim 3 wherein said means for releasing comprises a movable member on said first handle member coupled to said second element to cause corresponding movement between said second element and said movable member.

14. A mechanism including a modified four bar linkage in which a selective one of said linkages comprises a toothed arcuate segment pivotally coupled to an adjacent one of said linkages and cooperatively engaged with a releasable pawl means located on an elongate drive member pivotally coupled to said toothed arcuate segment to permit selective adjustment of the angular relationship between said drive member and said arcuate segment.

15. A mechanism as defined in claim 14 further comprising biasing means for urging said pawl means into engagement with said arcuate segment.

16. A mechanism as defined in claim 14 further comprising means for manually releasing the engagement between said pawl means and said arcuate segment.

* * * * *